US007698922B1

(12) United States Patent
Danko et al.

(10) Patent No.: US 7,698,922 B1
(45) Date of Patent: Apr. 20, 2010

(54) PERMANENT INVISIBLE MAGNETIC TAGS WITH DIGITAL DATA

(76) Inventors: Donald M. Danko, 3513 Scanwood Dr., Richfield, OH (US) 44286; Joseph H. Taddeo, 3446 Timberwood Trail, Richfield, OH (US) 44286-9755

( * ) Notice: Subject to any disclaimer, the term of this patent is extended or adjusted under 35 U.S.C. 154(b) by 968 days.

(21) Appl. No.: 11/474,701

(22) Filed: Jun. 26, 2006

Related U.S. Application Data

(63) Continuation-in-part of application No. 10/376,125, filed on Mar. 1, 2003, now Pat. No. 7,065,994.

(51) Int. Cl.

| | |
|---|---|
| ***B21K 1/74*** | (2006.01) |
| ***B21D 9/08*** | (2006.01) |
| ***B21C 51/00*** | (2006.01) |
| ***G01B 7/04*** | (2006.01) |
| ***G01N 3/00*** | (2006.01) |

(52) U.S. Cl. ..... 72/15.3; 72/31.01; 72/31.1; 430/322; 235/462.16; 235/493; 219/121.85

(58) Field of Classification Search ..... 72/15.1, 72/15.3, 20.5, 31.01, 31.1; 33/206, 751; 235/493, 449, 450, 462, 468, 494; 430/322, 430/320; 219/121.85

See application file for complete search history.

(56) References Cited

U.S. PATENT DOCUMENTS

| | | | | | |
|---|---|---|---|---|---|
| 4,471,304 | A * | 9/1984 | Wolf | 324/207.24 |
| 4,572,293 | A * | 2/1986 | Wilson et al. | 166/250.01 |
| 4,654,912 | A * | 4/1987 | Gray | 470/13 |
| 4,835,805 | A * | 6/1989 | Gray | 470/13 |
| 6,047,579 | A * | 4/2000 | Schmitz | 72/15.1 |
| 6,068,966 | A * | 5/2000 | Koga | 430/322 |
| 6,526,793 | B1 * | 3/2003 | Danko et al. | 72/17.1 |
| 6,527,193 | B1 * | 3/2003 | Beli et al. | 235/493 |
| 7,065,994 | B1 * | 6/2006 | Danko et al. | 72/17.1 |
| 7,204,419 | B2 * | 4/2007 | Lizotte et al. | 235/462.01 |
| 7,325,428 | B2 * | 2/2008 | Bruggink | 72/15.1 |
| 7,353,677 | B2 * | 4/2008 | Zusi | 72/15.1 |
| 7,513,135 | B2 * | 4/2009 | Denkmeier | 72/15.1 |

* cited by examiner

*Primary Examiner*—David B Jones
(74) *Attorney, Agent, or Firm*—Joseph H. Taddeo

(57) ABSTRACT

A permanent invisible magnetic marking and positioning system of unfinished ferrous rods, bars, workpieces, and the like. A midpoint, center or other point of the workpiece is automatically located and a high-energy pulse is applied for installing an embedded magnetic marker. The magnetizing heads can also be repositioned to various points on a workpiece for imparting digital manufacturing and product identification in a data strobe pulse, that is analogous to a picket fence, where each picket provides a weighted binary representation in a data array comprised of data cells.

17 Claims, 15 Drawing Sheets

A

PERMANENT INVISIBLE MAGNETIC TAGS WITH DIGITAL DATA

RELATION BACK TO PREVIOUSLY FILED APPLICATIONS

Applicants claim the benefit of domestic application Ser. No. 09/696,618, U.S. Pat. No. 6,526,793, issued Mar. 4, 2003, and domestic application Ser. No. 10/376,125, U.S. Pat. No. 7,065,994, issued Jun. 27, 2006.

FIELD OF THE INVENTION

The present invention relates primarily to a permanent magnetic marking and positioning system of unfinished and finished metal bars, workpieces and the like, and more particularly, to a means for embedding informational data in the workpiece that is stored and retrieved as data packets, wherein the data is stored in a packed, high density, digital packet, located in predetermined locations on the workpiece.

BACKGROUND OF THE INVENTION

In the manufacture of U-bolts, springs and other related parts, it is common to cut a long steel rod or bar into shorter sections of predetermined length. For U-bolts, each rod section remains straight and each is threaded along the opposite end portions. To produce a U-bolt, each of the threaded straight rods are then successively inserted into a hydraulic or powered bending and forming machine that cold forms each rod around a U-shaped mandrel.

Before performing the bending operation, an operator must place the unbent rod in the bending machine and position it using a tape measure to position it so that the midpoint of the rod is aligned with the center of the mandrel.

Meanwhile, for the manufacture of leaf springs, a center bolt holds all the leaves together and the head of the bolt locates the spring on the axle. Positioning of center bolt hole at a midpoint of the flat bar is required. With the steel red hot, the eyes are formed by pulling the steel around a mandrel. The prior scarfing operation allows for round eyes.

When rods of different lengths are being successively formed into U-bolts, it is necessary to readjust the adjustable stops for each rod that is different in length. This requires additional setup time for each group of rods being formed. Still more time is wasted in determining the longitudinal center of the rod, and then positioning it over the center of the mandrel. This manual process is also subject to human operator error due to fatigue.

Visual marking and forming machines used for the production of U-bolts is well known in the prior art. Disclosed are several forming machines that use a variety of longitudinal center marking methods. Examples of such prior art are shown in the patents that follow.

U.S. Pat. No. 4,835,805, granted Jun. 6, 1989, to J. C. Gray, discloses the production of threaded metal rods for making U-bolts, where straight cylindrical metal rods are threaded along opposite ends and the center portion is marked to form a visual indicator of the longitudinal center of the rod. The mark identifying the center of each rod extends circumferentially around the metal rod and is formed by a stripe of color contrasting ink directly to the rod provide a permanent mark that does not require rotating the rod to find the mark. The mid-point mark on each rod is aligned with the center plane mark on the machine and the rod is bent to form a precision U-bolt.

U.S. Pat. No. 4,654,912, granted Apr. 7, 1987, to J. C. Gray, discloses the production of threaded metal rods for making U-bolts, where straight cylindrical metal rods are threaded along opposite ends and the center portion is marked to form a visual indicator of the longitudinal center of the rod. The mark identifying the center of each rod extends circumferentially around the metal rod and is formed by a stripe of color contrasting ink to provide a permanent mark that does not require rotating the rod to find the mark. The mid-point mark on each rod is aligned with the center plane mark on the machine and the rod is bent to form a precision U-bolt.

U.S. Pat. No. 4,572,293, granted Feb. 25, 1986, to J. G. Wilson, et al., discloses a method for placing magnetic markers on collarless cased wellbores. A magnetic marker is used to locate wireline tools in wellbores using collarless housing. The magnetic marker is applied at selected positions on the casing before or after placing casing in a well.

U.S. Pat. No. 4,446,711; issued to Raymond L. Valente on May 8, 1984, discloses and claims a novel improvement for a U-bold bender.

Still another prior art patent, U.S. Pat. No. 4,572,293, issued to Wilson, et al., on Feb. 25, 1986, discloses the use of magnetic depth markers placed at regular vertical intervals for depth of wireline tools during a logging run.

The prior art recited above does not teach of the novel advantages that are found in the present invention. Several teach of using visual stripes using tapes or labels to mark the center of the rod being formed.

Accordingly, it is therefore an object of the present invention to provide a novel positioning means to locate the longitudinal center of a cylindrical steel rod prior to being cut to a desired predetermined length.

It is another object of the present invention to provide a novel magnetic marking means at the longitudinal center of a cylindrical steel rod prior to being cut to a desired predetermined length.

It is still another object of the present invention to provide a novel positioning and longitudinal centering means for a magnetically marked cylindrical steel rod so that it can be formed into a precise U-bolt, having equal and symmetrical ends or magnetically imprinting each bar for a leaf spring, at the midpoint or other location of a hole to be pierced.

Yet another object of the present invention is to provide a novel method of marking a cylindrical steel rod, using a permanent non-visual marker, to provide a aided identification of the manufacturer in the event of a catastrophic failure of the entire assembly, such as in an aircraft failure.

Final objects of the present invention include providing a means for locating a desired point on the workpiece and a means for embedding in the workpiece at the desired point a permanent invisible magnetic tag having a digital signal in a form of a picket fence.

These as well as other objects and advantages of the present invention will be better understood and appreciated upon reading the following detailed description of the preferred embodiment when taken in conjunction with the accompanying drawings.

SUMMARY OF THE INVENTION

The present invention relates primarily to a novel permanent magnetic marking and positioning system of unfinished metal bars, which aligns a cylindrical ferrous rod to its longitudinal center point (or balance point) prior to forming in a bending and forming machine.

In one aspect of the present invention, the ferrous rod that is used to manufacture the U-bolts is magnetically marked at its center-point and then cut to the desired length by longitudinally inserting the raw cylindrical rod into a cutoff saw station or machine until it comes in contact with a stop that is set to the desired predetermined length. The frame includes at least one magnetizing head each including an electromagnetic coil. An automatic centering device positions each magnetizing head located at the longitudinal center, on each side, of the rod. While positioned at a midpoint of a secured rod a high energy current pulse is provided across the coil to the rod, thereby magnetically marking the midpoint of the rod with a permanent invisible magnetic mark indicator of a longitudinal center of the rod.

The system is automated, for when the raw cylindrical rod comes in contact with the stop, it closes a switch which results in sending a high energy current pulse to an electromagnetic coil mounted on each magnetizing head, thereby magnetically marking the midpoint of the steel rod prior to being cut to the desired predetermined length. Typically, the pulse is rectangular, having an amplitude in the range of 5 to 150 volts, preferably 24 volts and a duration in the range 10 to 500 milliseconds, preferably at least 100 milliseconds.

After each magnetically marked rod is suitably cut to the desired predetermined length, each of the opposite ends is threaded to the desired thread size.

In another aspect of the present invention, the unbent threaded steel rod is positioned in the hydraulic or powered bending machine, so that the longitudinal center of the rod is aligned to the center of the bending mandrel. A peak magnetic detector is used to locate the magnetic center of the rod. The peak detector gives a visible presentation on a meter, in either digital or in analog form, or even gives an audible 'beep' at the located midpoint. A centering indicator having peak magnetic strength detection allows manual or automatic positioning of the rod so that the center of the magnetic mark is perfectly aligned with the center of the bending mandrel. Once the midpoint of the rod is positioned and aligned with the center of the mandrel, the straight threaded rod is formed into a U-bolt.

The magnetic mark remains permanently embedded at the crest of the formed U-bolt, thereby rendering a permanent tag identifying the origin of the U-bolt.

As such, the invention comprises a system for locating and marking a midpoint of unfinished rod stock placed on a support frame, table, workbench or cutoff station, with a means for securing a rod in a fixed position, a means for locating a longitudinal center of the rod before being cut to length and, a means for embedding in the rod a permanent invisible indicator of the longitudinal center of the rod. The frame includes a repositioning end stop for receiving rods of varying lengths, the end stop having an associated microswitch actuated by contact with a rod inserted on the frame and communicating with a grip, for closure of grip to automatically secure the rod in the desired position for marking a midpoint of a specified rod length.

When in use, the invention provides a method of efficiently producing heavy duty U-bolts of different sizes, wherein each U-bolt has two legs of substantially equal length. The method includes the steps of providing a supply of straight metal rods with opposite ends, smooth cylindrical outer surfaces, different predetermined lengths, and transverse center planes defining a longitudinal center of each rod substantially equidistant from the ends of each rod. Helical threads are formed on opposite end portions of each rod, which are successively fed into a marking machine having an at least one relative movable magnetizing head with means for embedding an invisible magnetic mark center indicator to the rods. The rods are successively marked by imparting a current pulse from an electromagnetic coil at substantially the transverse center plane of each rod to produce a permanent invisible magnetic mark center indicator at the longitudinal center of each rod, whereupon the rods are successively transferred from the marking machine and inserted into a forming machine with a mandrel for bending.

The rods are supported between two mandrel bending members which are relatively movable with respect to each other, the mandrel having a magnetic detector, a mandrel center mark, and a surface for supporting the rod between its ends during bending. Each rod is positioned with the embedded magnetic mark center indicator in alignment with the mandrel center mark by use of the magnetic detector, succeeded by moving the mandrel and the bending members with respect to each other to bend each rod around the mandrel surface. The bending members engage the rod in an area spaced longitudinally from the permanent invisible magnetic mark center indicator of each rod. In this manner; a U-bolt having two legs of substantially equal length is produced from each rod for providing a supply of U-bolts differing in leg length size from each other with minimum scrap resulting from differing leg lengths in a single U-bolt.

In an alternative embodiment, the magnetic mark is made using two magnetizing heads on either side of the cylindrical rod, where the first head imparts a magnetic north imprint and the second head, a magnetic south imprint. By using a double magnetic imprint, a discriminator circuit is used to locate the magnetic center, which with correct calibration, coincides with the midpoint of the rod.

As such, the objects of the invention are achieved by providing a system for locating and marking a point on an unfinished workpiece, including a means for securing a workpiece in a fixed position, a means for locating a desired bending, tapping or other marking point for a manufacturing process on the workpiece and, a means for embedding in the workpiece a permanent invisible indicator at the desired marking point of the workpiece. The permanent invisible indicator is a magnetic mark imparted by one or more magnetizing heads having an electromagnetic coil and positioned at the desired marking point of the workpiece. The magnetic mark is embedded at the desired marking point by applying a current pulse across said coil.

The magnetizing head moves in a path parallel to the longitudinal axis of the workpiece. Meanwhile, the desired magnetic marker may also be imparted by a pair of magnetizing heads each located on an opposite side of the workpiece, mounted on identical positioning means and fixed to identical armatures, such that each magnetizing head is directed to the desired marking point of the workpiece for magnetically marking the workpiece at said point. Also, two adjacent magnetizing heads of opposite polarity fixed on a positioning armature on a same side of the workpiece, which impart a first magnetic imprint and a second magnetic imprint of opposite polarity to the workpiece. The magnetizing heads can also be repositioned to many points on a workpiece for imparting manufacturing and product identification data.

In still another aspect of the present invention, informational data can be stored and retrieved as data packets that are stored in a'packed, high density, digital packet, located in predetermined locations on each type of workpiece.

It has previously been demonstrated that data can be presented one character at a time. However, it's more efficient to store and send information in larger blocks called data packets. These data packets generally include some extra bits for error checking.

The data packet is a basic data file used when storing or retrieving information from the workpiece to a data retrieval unit. The maximum length of the packet depends on the bit packing density and the available area dedicated to data storage on the workpiece medium.

The data packet is divided into three major regions: the header, the data storage array and the checksum region, having an error-checking number. The header contains information needed for storing and retrieving the data; the data storage region is the body of the packet that is ultimately received, and the checksum determines the data integrity of the retrieved or stored data.

In the digital signal world, it is informative to think of the entire signal span of a digital data packet as equivalent to the entire length of something discrete and easily visualized such as a picket fence.

Using that analogy, it can be seen that there are basic pieces of information, which can be known about any picket fence and none of those separate elements, such as the picket, tell all there is to know about the fence.

The intent of the analogical explanation is to aid in understanding the various ways in looking at the contents of a data packet. The entire length of the picket fence represents the entire length of the quantity of data. Each picket of the fence represents one "bit" of stored data and each contiguous group of eight bit lengths represents one data "byte."

The length of a data cell is often considered to be arbitrary, can range from a grouping of 4-bits to as many as 32-bits, dependent upon the application.

The data storage array in the data packet may be comprised of such information, for example, as, the part number, date of manufacture, type of material used, i.e., steel, stainless, etc., height, width, and the like.

As an alternate consideration, when there is an insufficient number of bits available in a data packet, data compression technologies can be used to compress the data when storing the original data; and upon data retrieval, the data block can be uncompressed to restore it to its original format.

Again, alternatively, for use in military applications or for use in covert applications, where a parts nomenclature could disclose sensitive information during the failure of the entire ensemble, the data storage array of the data packet region on the workpiece can be encrypted. And of course, when valid equipment is used the verify the content of the stored data packet, the data array can be decrypted to derive the original formatted array.

BRIEF DESCRIPTION OF THE DRAWINGS

The present invention is pictorially illustrated in the accompanying drawings that are attached herein.

DETAILED DESCRIPTION OF THE PREFERRED EMBODIMENT

Figure 1:
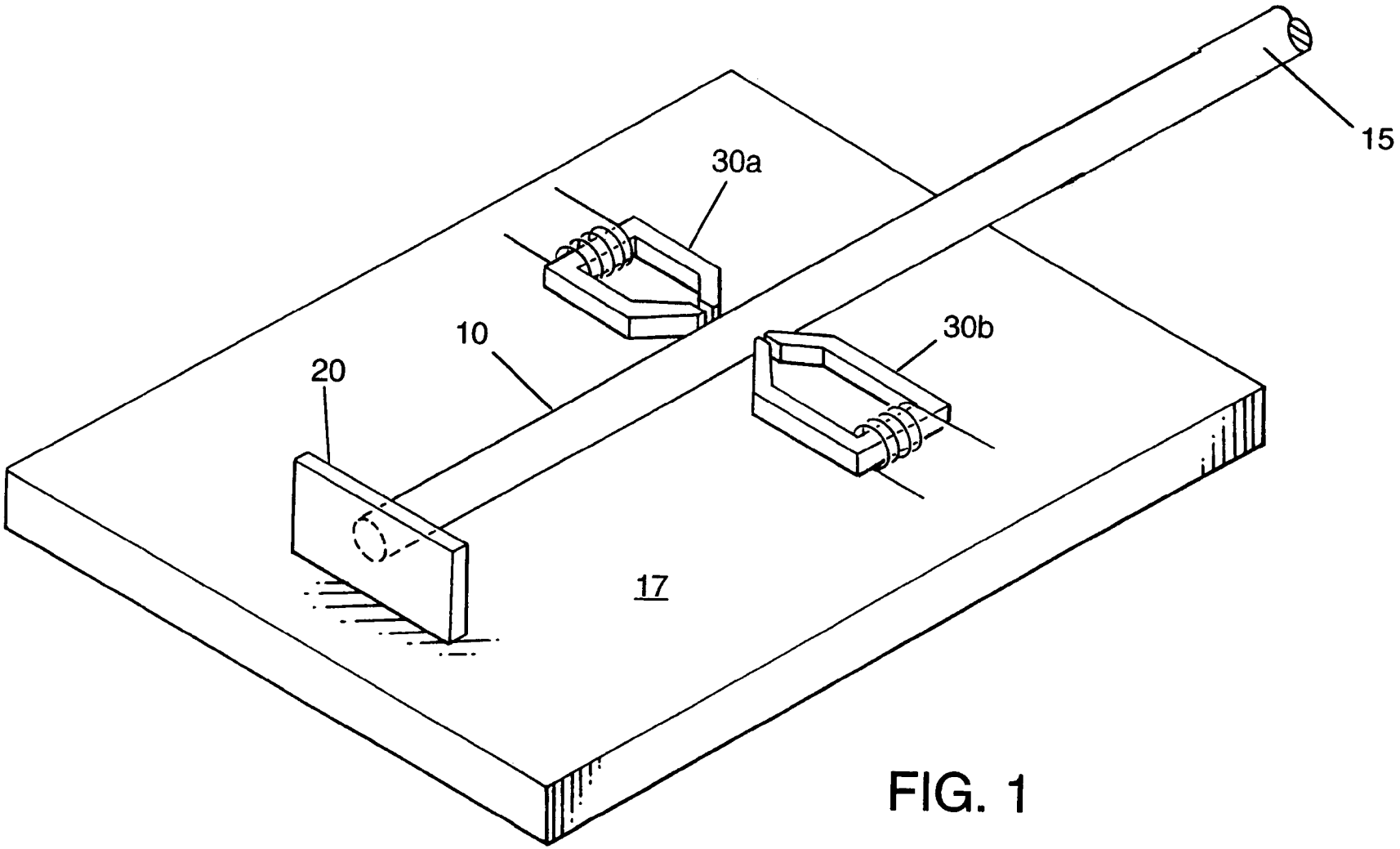
FIG. 1 is a perspective view of a straight cylindrical steel rod, positioned at the stop, where the magnetizing heads are positioned at the midpoint of the rod, prior to being cut to the desired specified length.

Referring to FIG. 1, the cylindrical metal rod 10 is shown being cut to the desired length, from the metal rod stock 15. The rod stock 15, stabilized on a table, workbench or support frame 17, is inserted longitudinally into the cutoff station until it reaches the end stop 20. Two magnetizing heads 30*a* and 30*b*, each bearing a coil 30, are placed on either side of the inserted cylindrical rod stock 15 at its midpoint, where it is magnetically marked by passing a momentary pulse of DC current through the coil of the magnetizing heads. Upon completion of magnetically marking the longitudinal center of the metal rod, it is cut to the desired length using cutoff saw 25.

The straight metal rod 10 is commonly manufactured in a wide range of diameters that range from ¼ inch to 1¼ inches. Depending upon the application, the material composition that is used for the U-bolts can be of a mild steel.

Figure 2:
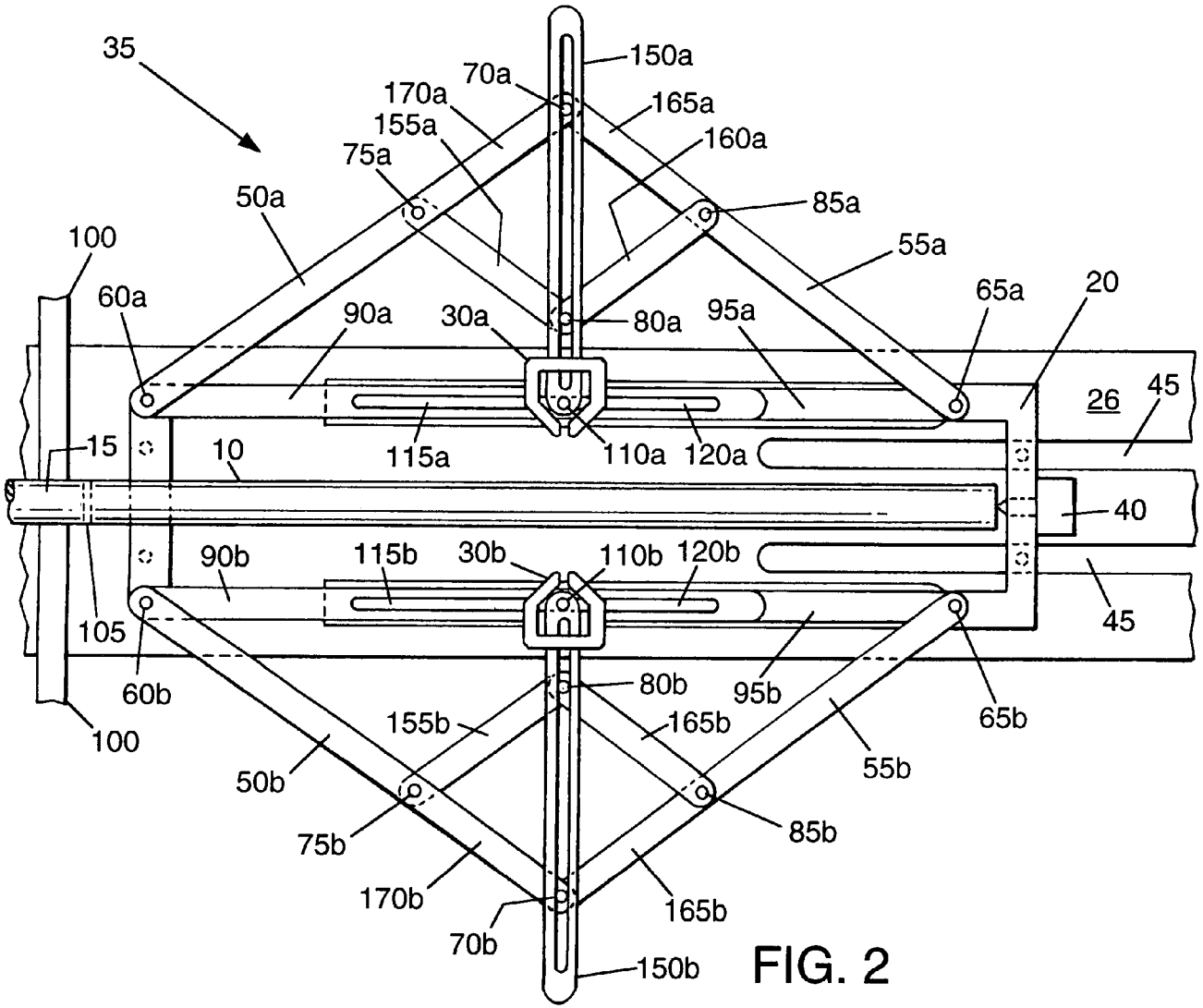
FIG. 2 is a plan view of the novel dual midpoint locating device as applied to the cutoff station.

To provide an automated means of finding the midpoint of the cylindrical rod portion 10, before it is cut to length, a novel dual head positioning linkage 35 mounted upon the cutoff station base 26 is shown in FIG. 2.

The end stop 20 is positioned in the cutoff station by sliding it along the track openings 45, then securing it when the desired position is reached. The metal rod stock 15 is inserted into the cutoff station until it comes in contact with end stop 20, where it actuates micro-switch 40. Upon the closure of microswitch 40, the grip or rod-clamps 100 grip the uncut cylindrical rod stock 15 maintaining it securely in position. With the uncut rod 15 being held securely in position, a short high energy current pulse energizes the magnetizing heads 30*a* and 30*b* to invisibly mark the midpoint of the rod before it is cut to its final length. The rod is then cut to length along the section designated as 105.

As illustrated, the upper portion of the head positioning and centering linkage apparatus is comprised of equal arms 50*a* and 55*a*, and telescoping arms 90*a* and 95*a*, which form an equilateral triangle. Bisecting center arm 150*a* subdivides the angle formed by arms 50*a* and 55*a*, by virtue of the fact, that arm 155*a* is parallel to arm section 165*a*, and arm 160*a* being parallel to arm section 170*a*, thereby forming a parallelogram while maintaining arm 150*a* precisely directed toward the midpoint of the rod being cut off. The head 30*a*, being firmly attached to arm 150*a*, moves in a path that is parallel to rod 15, by virtue of the follower guide pin 110*a* traversing through the slotted channels 115*a* and 120*a* found in telescoping arms 90*a* and 95*a*, which form the base of the triangle. By maintaining the accuracy of the arms, with respect to the distances between pivots 60*a*, 65*a*, 70*a*, 75*a*, 80*a* and 85*a*, the center arm bisects an angle between the equal arms 50*a* and 55*a* and bisects the telescoping base 90*a*-95*a*. The magnetizing heads 30*a* and 30*b* will always be positioned at the midpoint of the rod being prepared for use, independent of the change in tooling setup for different U-bolts, having varying lengths and diameters. Additionally, to preserve the setup accuracy, it is necessary that the horizontal distance between the saw cut 105 and the pivot 60*a* be equal to the horizontal distance between the inner surface of end stop 20 and the pivot 65*a*.

The lower portion of the head positioning and centering apparatus is an identical mirror image of the left side portion where all numerical designators are suffixed with the letter 'b'.

Figure 3:
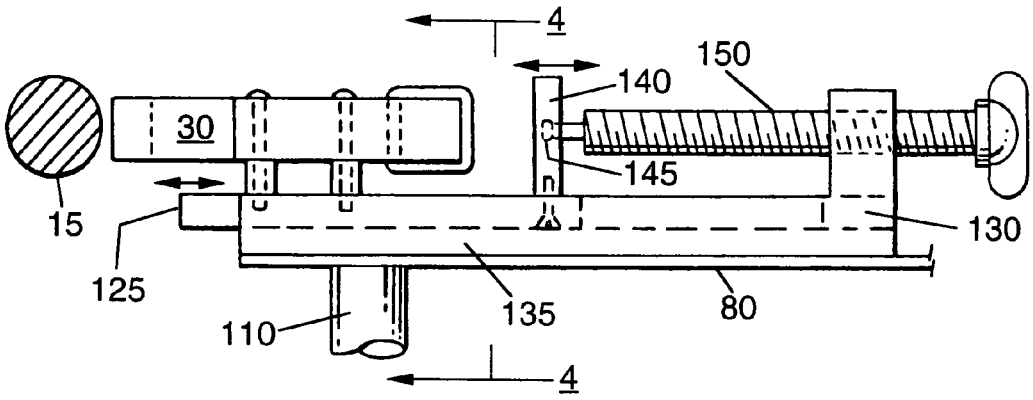
FIG. 3 is an exploded side view of the magnetizing head inward positioning arrangement.
Figure 4:
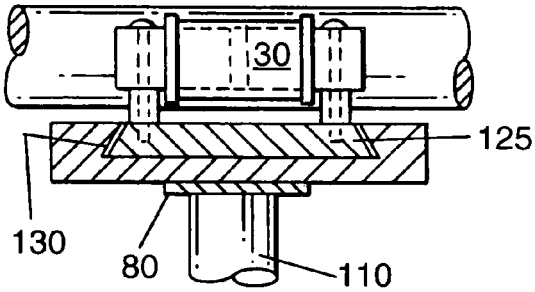
FIG. 4 is a sectional view of the magnetizing head inward positioning

Turning now to FIGS. 3 and 4, there is shown in detail, the head extension apparatus. The coil 30 of a magnetizing head 30*a*,30*b* is mounted to the slide carriage 125, having a truncated triangular cross-section that traverses its mating receiving channel 130 in slide base 135. The entire slide apparatus is mounted orthogonal to the rod 15. Also attached to the slide carriage 125 is an adjustor receptacle 140 that captivates the ball end 145 of the head adjustment screw shaft 150. The base 135 is rigidly mounted on top of the armature or arm 80, and the follower guide pin 110 is attached below to the bottom of the armature or arm 80.

Figure 3A:
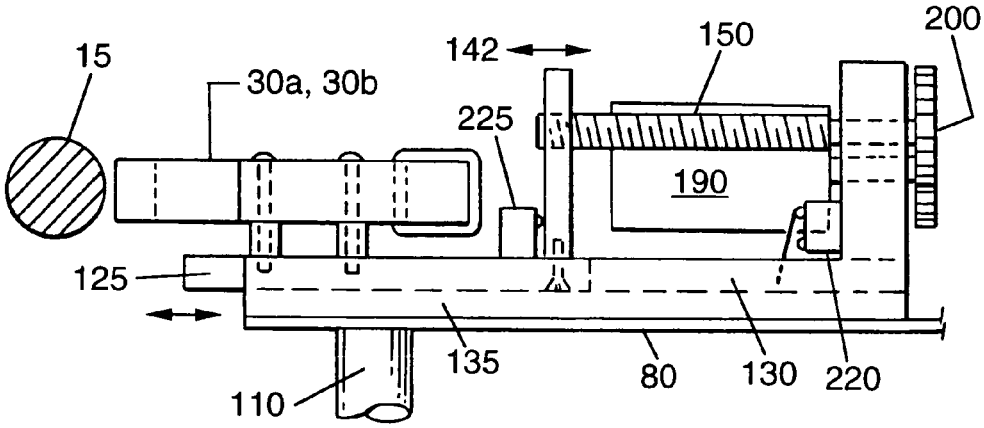
FIG. 3A is a side elevation of the magnetizing head inward positioning arrangement having a motorized drive to position the pulse marking magnetizing head.
Figure 3B:
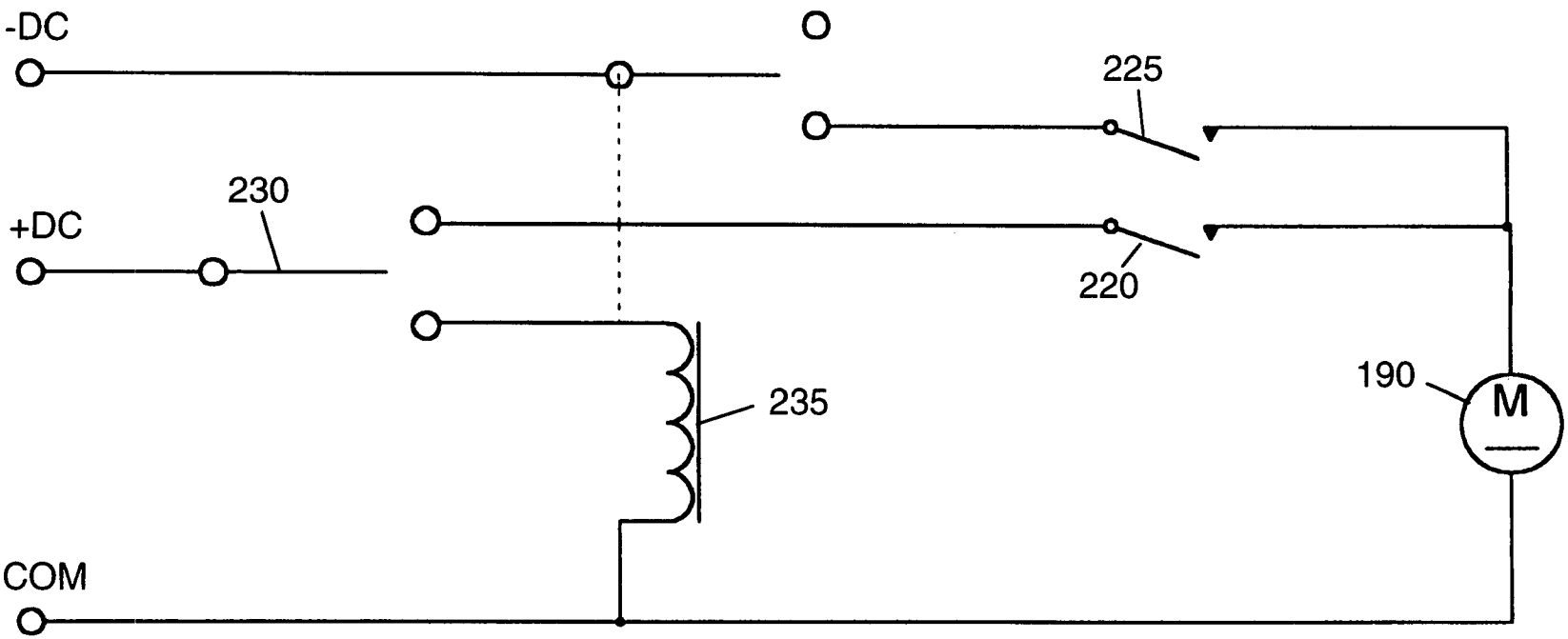
FIG. 3B is a schematic drawing showing the detailed electrical connections to the DC motor for the motor reversal sequences to position and retract the magnetizing heads. arrangement.

In a first alternative embodiment, as shown in FIGS. 3A and 3B, the orthogonal head positioning assembly may be motorized to enable the heads to be retracted when the uncut rod is inserted into the cutoff station. When the rod reaches the end stop, the microswitch 230 is actuated and the heads 30*a* and 30*b* are restored to their operating positions.

In typical operation, with no rod in the cutoff station, the magnetizing heads 30*a* and 30*b* are in their fully retracted outward position. When an uncut rod 15 is inserted into the cutoff station, the rod is positioned forward toward the stop 20 until it depresses the rod position-sensing switch 230. Upon actuation of switch 230, the relay 235 becomes energized, causing its relay contacts to close, which results in the reversible motor, preferably a DC motor 190 to rotate in a clockwise direction. Mounted to the shaft of the DC motor 190 is a pinion assembly 200, with a small pinion (not shown) engaged with the larger pinion 200 to cause the screw shaft 150 to rotate in a counterclockwise direction. The screw shaft 150, being screwed into the threaded head adjustor receptacle 142, causes the magnetic heads 30*a* and 30*b* to move inwardly, via carriage 125, toward the uncut rod 15. When the head adjustor receptacle 142 comes in contact with forward adjustable travel limit switch 225, it actuates the switch causes the motor 190 to stop its rotation. The switch 225 is suitably mounted so that it can be adjusted for the varying diameters of rods during the setup procedure.

After the magnetizing pulse is imparted into the metal rod 15, the rod is cut to the desired length 10 in the saw cut region 105. Upon completion of the saw cut, the cut rod 10 drops releasing its contact with rod sensing switch 230, causing the motor 190 to start rotating in the reverse direction. Concurrently, the rod clamp jaws 100 are subsequently disengaged releasing the clamped rod 15. The motor 190 continues rotating in the same direction until it contacts travel limit switch 220, which opens the switch contacts, resulting in the motor to stop its rotation. The magnetizing heads 30*a* and 30*b* now have been moved into their fully retracted position, allowing the uncut rod to be inserted without causing damage to the heads, which completes the cycle for this operation.

Figure 5:
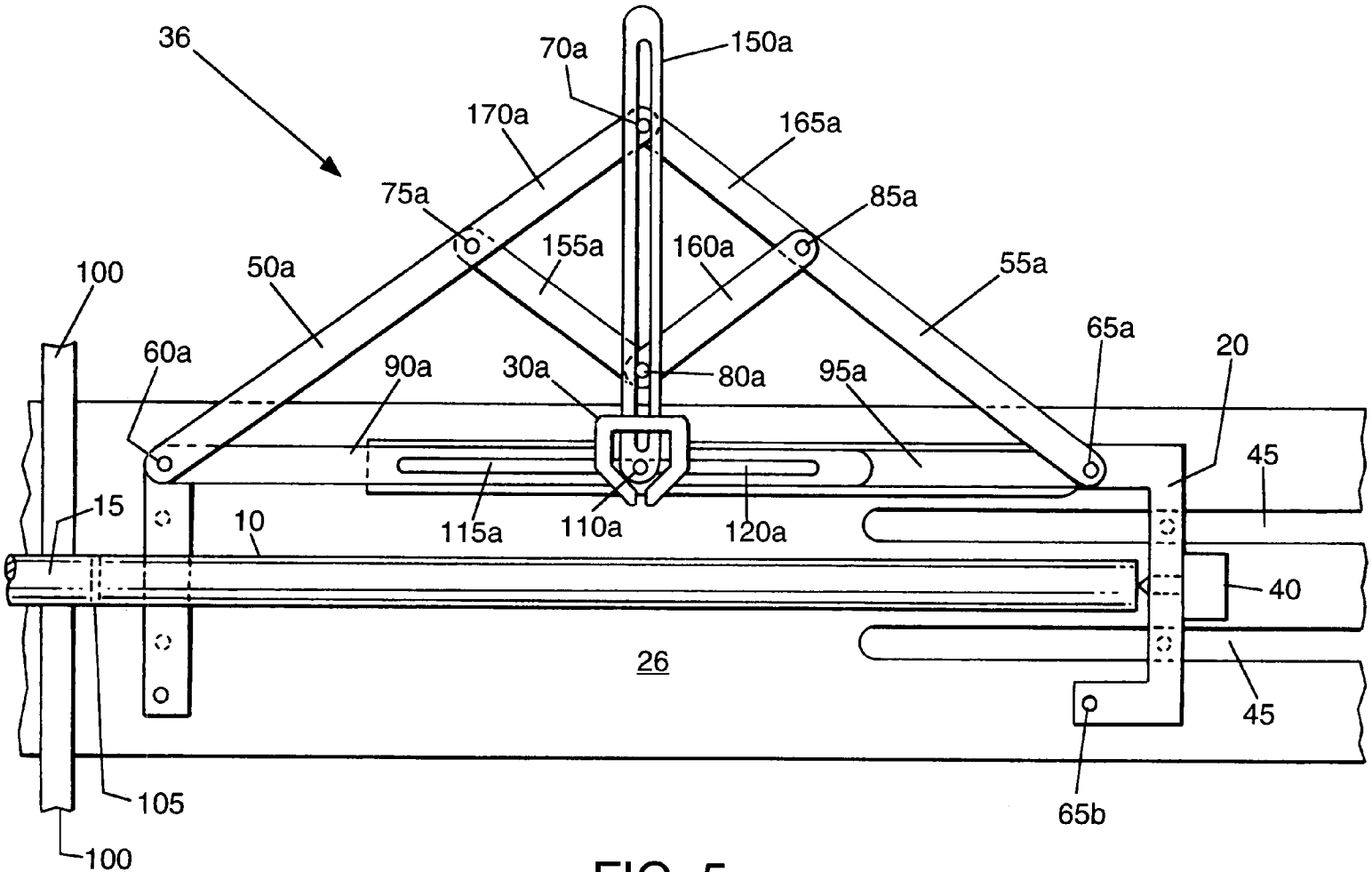
FIG. 5 is a plan view of an alternative embodiment showing a single magnetizing head positioned at the midpoint of the rod as applied to the cutoff station.

In a second alternative embodiment, FIG. 5 illustrates a single magnetizing head centering and positioning mechanism that may be used when the rod diameters are of reduced size. The single head positioning and centering apparatus 36 is identical to the upper linkages as shown in FIG. 2, where all of the numerical designators are suffixed with the letter 'a'.

Figure 6:
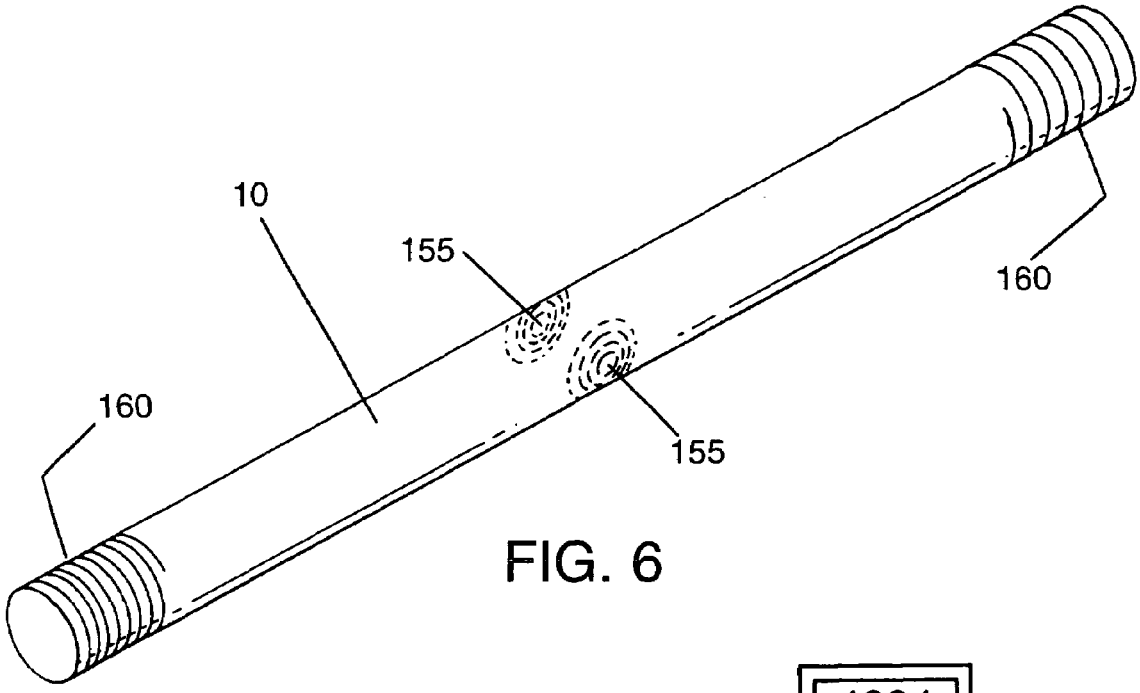
FIG. 6 is a perspective view of a straight metal rod having opposite threaded end portions and a center portion with a permanent magnetized mark indicating the midpoint of the rod as located and embedded pursuant to the present invention.

FIG. 6 illustrates the cylindrical steel rod 10 after being first receiving the invisible magnetic mark 155, subsequently cut to the desired length, and then in an ensuing operation, having both ends receiving threaded portions 160.

Figure 7A:
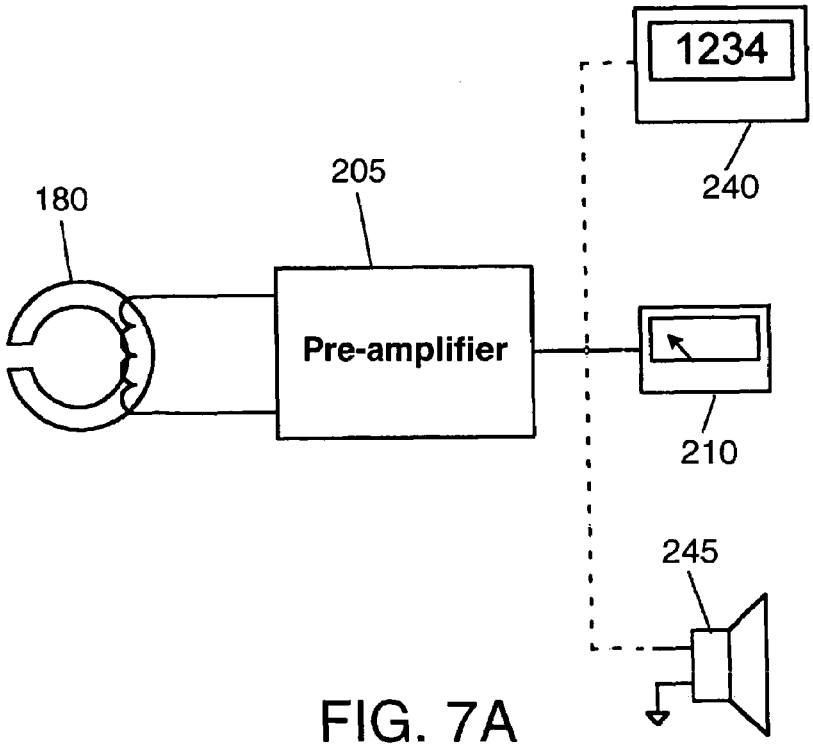
FIG. 7A is a block diagram that illustrates the magnetic mark pickup head, connected to a preamplifier, whose output is an analog meter that shows the meter deflection being proportional to the intensity of the magnetic mark.
Figure 7:
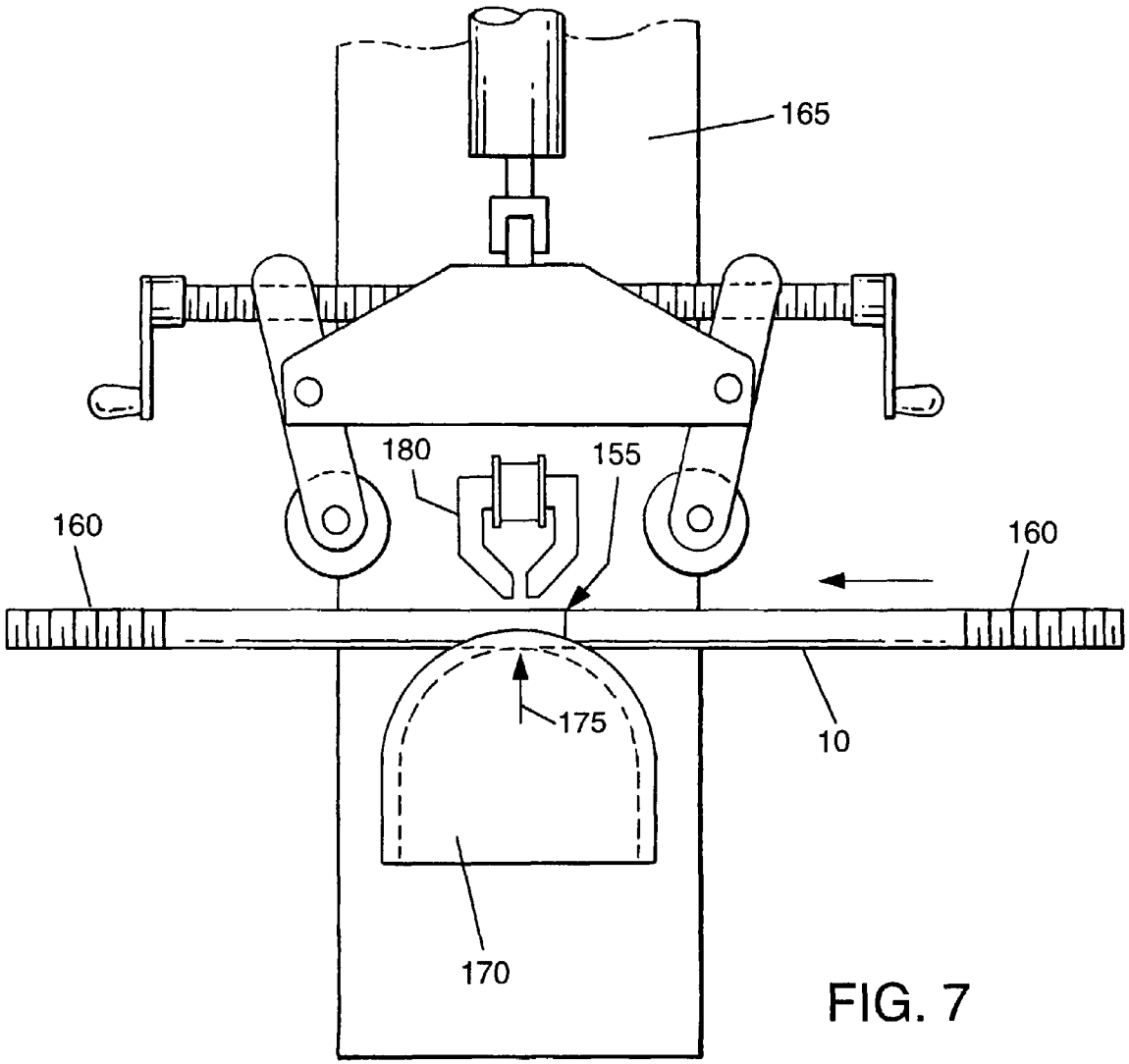
FIG. 7 is a side elevational view of one form of a manual rod bending-machine used to form a U-bolt having a magnetic sensing head to determine the location of the magnetic mark.

FIG. 7 illustrates a manual U-bolt bending machine 165 adapted to receive a magnetic mark pickup head 180 to detect the magnitude of the recorded magnetic midpoint mark. The output of the pickup head 180 is amplified, then displayed on a meter connected to the amplifier output. As the rod 10 is moved to the left, as shown, the meter deflects to a maximum indicating a maximum peak that coincides with the midpoint of the rod 10. When the magnetic mark coincides with the center alignment mark of the mandrel 175, the bending of the rod 10 to form a U-bolt may commence.

There is shown in FIG. 7A, a block diagram that illustrates the magnetic mark pickup head 180, connected to preamplifier 205, whose output is an analog meter 210 that shows the meter deflection being proportional to the intensity of the magnetic mark. It may be advantageous to provide alternatively a digital numeric readout 240 to give the operator a more precise readout of the imprinted magnetic mark. In still another embodiment, a speaker 245 connects to the amplifier output to provide an audible output that is proportional to the magnetic intensity, thereby enabling the operator to manually position the rod without having to observe a panel meter readout.

Figure 8:
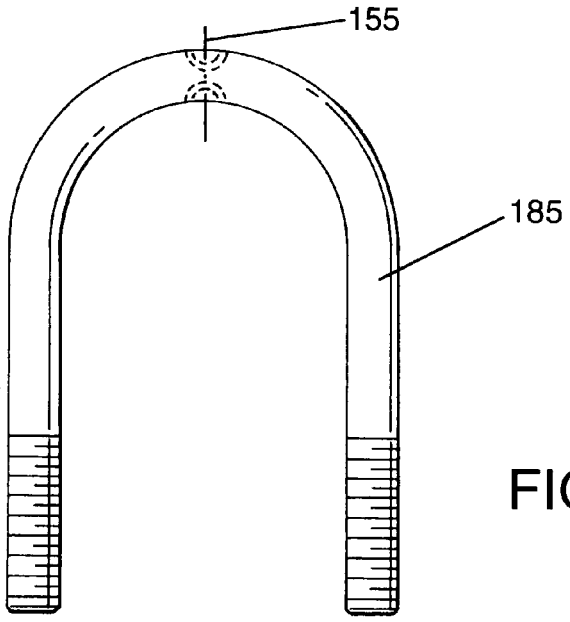
FIG. 8 is a side elevational view of a U-bolt formed from a rod as illustrated in FIG. 1.

FIG. 8 shows a finished manufactured U-bolt 185, after being formed in the U-bolt bending machine, having the invisible magnetic mark 155.

Figure 9A:
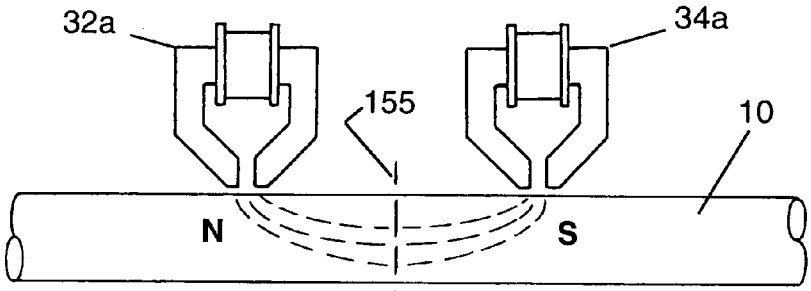
FIG. 9A is an exploded view of the magnetic mark imparted by two magnetizing heads, each of opposite polarity, on the same side of the cylindrical rod.
Figure 9B:
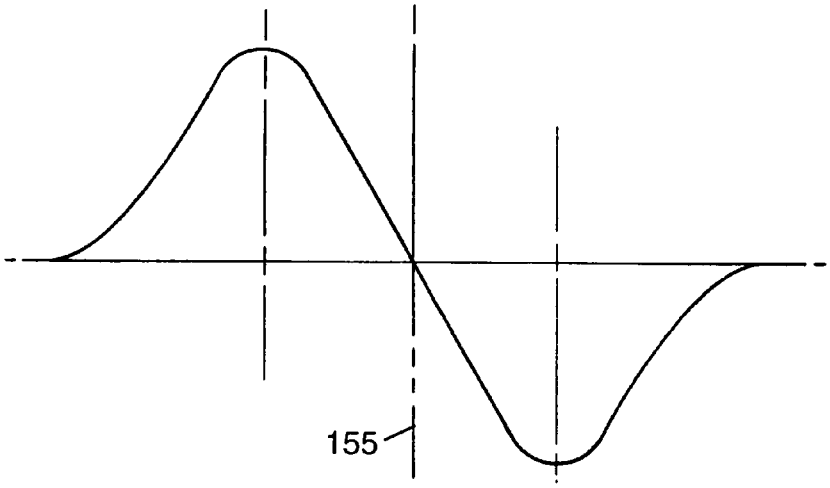
FIG. 9B details the corresponding electrical discriminator output with reference to the magnetically marked cylindrical rod as shown in FIG. 9A.

FIGS. 9A and 9B illustrate another embodiment, where the magnetic mark is made by having two magnetizing heads 32*a* and 34*a*, of opposite polarity, placed next to each other on the same side of the cylindrical rod. The first head 32*a* imparts a magnetic north imprint and the second head 34*a*, a magnetic south imprint. With a double magnetic imprint, with each having a comparable magnetic strength, a discriminator circuit is used to locate the magnetic center, (a zero crossing as displayed on a galvanometer), which with correct calibration, coincides with the midpoint of the rod. The midpoint is precisely where the output of the discriminator output crosses zero.

Figure 10:
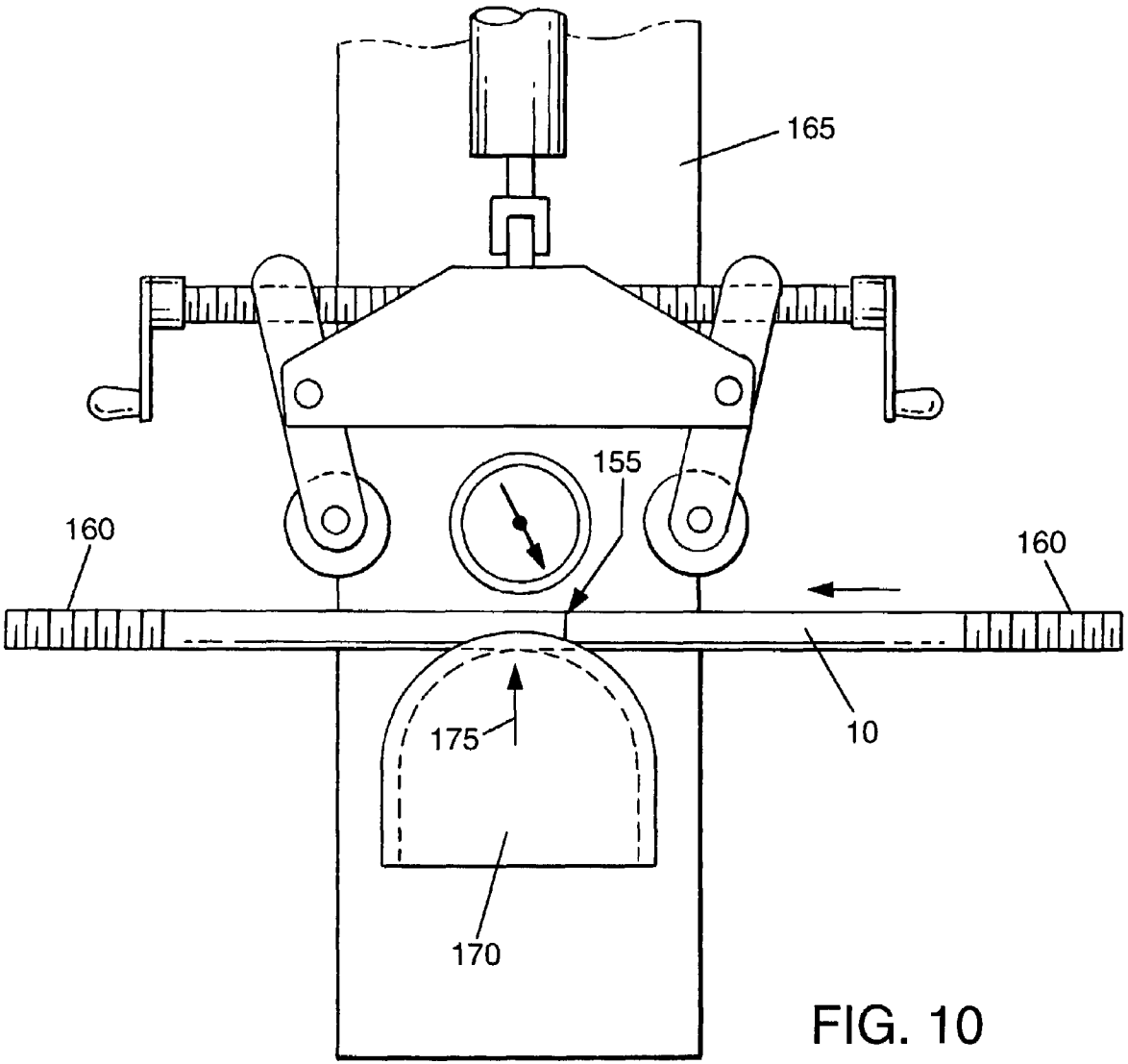
FIG. 10 is a side elevational view of an alternative embodiment having one form of a manual rod bending-machine used to form a U-bolt using a compass-like visual indicator to determine the location of the magnetic mark.

FIG. 10 illustrates still another embodiment where a simple magnetic indicator locates and displays the magnetic center mark imparted to the steel rod. The magnetic indicator is similar to that of a direction finding compass where the indicator points toward the midpoint of the invisible permanent magnetic mark instead of pointing to the earth's magnetic north.

Figure 11:
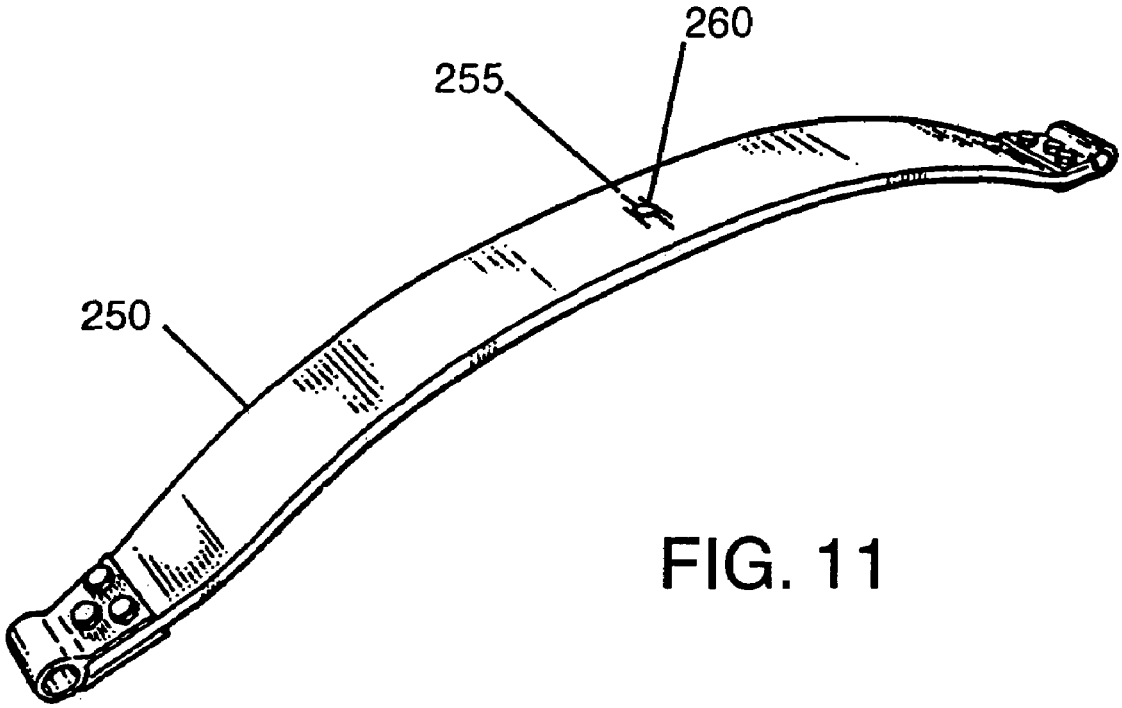
FIG. 11 is a perspective view of a single leaf of a single leafed, leaf spring, having a centrally located hole.
Figure 12:
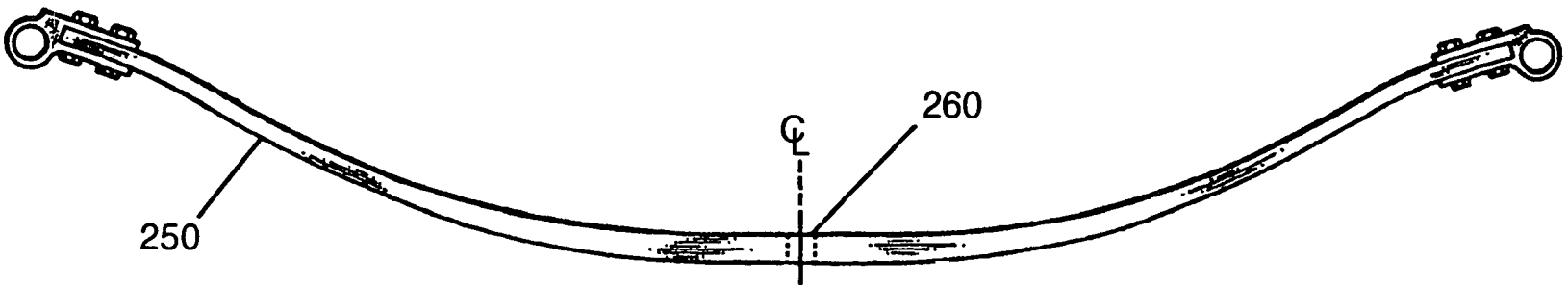
FIG. 12 is a side elevational view of a single leafed, leaf spring, having a centrally located hole.
Figure 13:
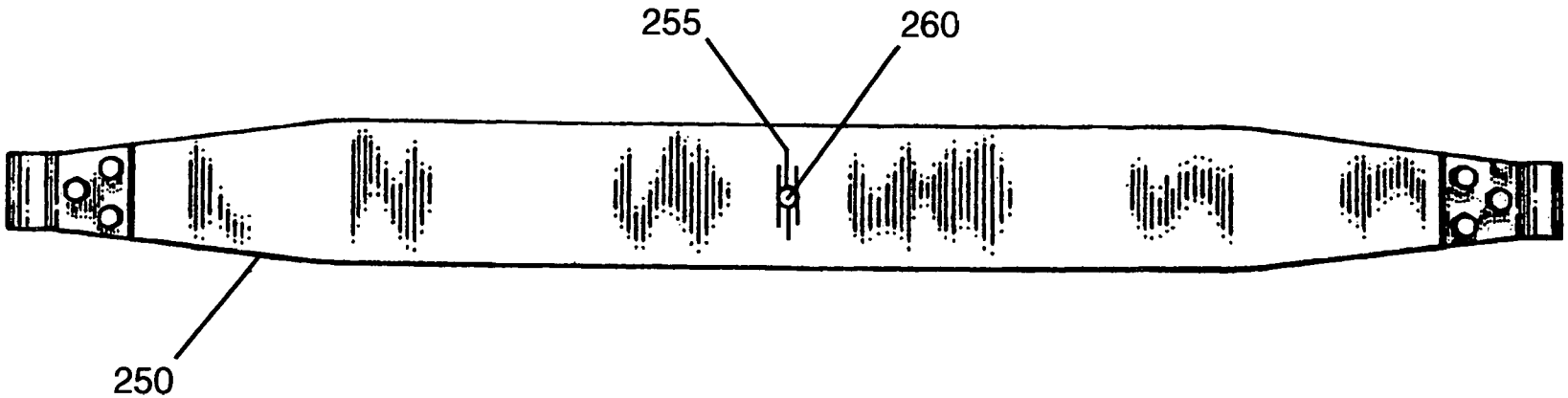
FIG. 13 is a top elevational view of a single leafed, leaf spring, having a centrally located hole.

Turning now to FIGS. 11, 12, and 13, there is shown a typical example of a single leafed, leaf spring 250 of the type to be manufactured, where the centrally located hole 260 is to be punched.

In the manufacture of leaf springs, the proper sized steel is selected from the many available stock sizes. Upon the proper selection of the steel stock, it is sheared to the desired length shown on the blue print.

After the raw bar is sheared to it may be transferred to another workstation where it may be positioned to located the center of the workpiece, and subsequently magnetically marked to indicate the exact position where the hole is to be pierced. Because the magnetic mark 255 is invisible to the naked eye, the mark is shown diagrammatically as three parallel lines, where the line in the middle between two shorter lines, is shown as the longer line, which demarks the center line of the hole to be punched.

Upon completion of the marking process, the workpiece is transferred to the area where the presses are found. Each press is instrumented with the magnetic sensing heads and positioning system. A 60-ton press is typically used to pierce each leaf to provide the hole for a center bolt.

Figure 14:
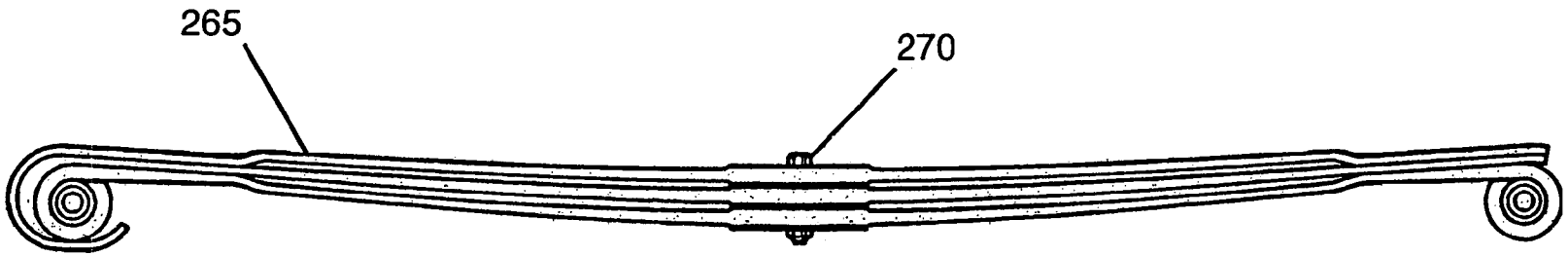
FIG. 14 is a side elevational view of a multiple leafed, leaf spring assembly, having a centrally located holes in each leaf.
Figure 15:
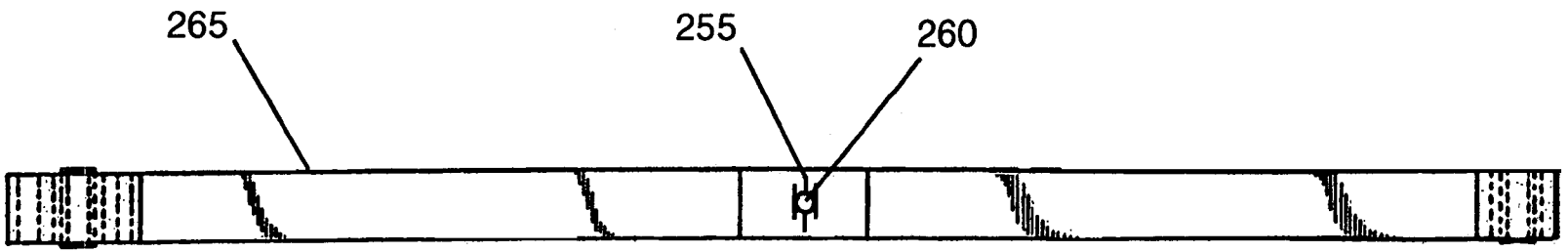
FIG. 15 is a top elevational view of a multiple leafed, leaf spring assembly, having centrally located holes in each leaf.

Shown in FIGS. 14 and 15, is an assembly of multiply leaved, leaf springs 265, where each leaf has the location of the hole to be pierced, magnetically imprinted. Each leaf is then individually pieced in the punch press with a hole, found precisely at the central location as marked magnetically. Center hole 260 is used to align the multiple leaves together, where in the final assembly, a center bolt and nut 270 holds all the leaves together.

The magnetizing heads can also be repositioned to various points on a workpiece for imparting manufacturing and product identification in the digital format of a data strobe pulse, analogous to a picket fence, where each picket provides a weighted binary representation in a data array comprised of data cells. There shown in FIG. 16A, a picket fence analogue, where each picket of the fence is analogous to the sample data strobe pulse, shown in FIG. 16C, to the "1" level of the Data Signal shown in FIG. 16B. The absence of a picket is analogous to the sample data strobe pulse, shown in FIG. 16C, to the "0" level of the Data Signal shown in FIG. 16B.

Figure 16A:
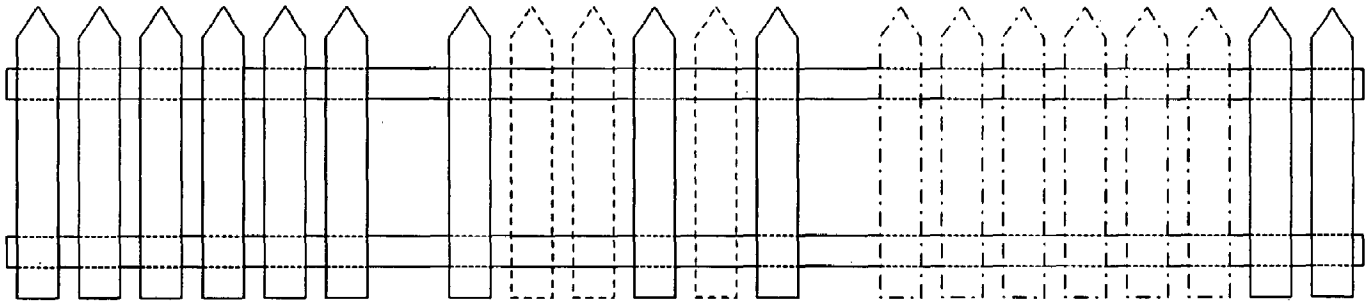
FIG. 16A is a drawing showing a typical 6-bit data cell picket fence, which is analogous to the pulses shown in FIG. 16B, when sampled by the "Sampled Data Strobe," shown in FIG. 16C.
Figure 16B:
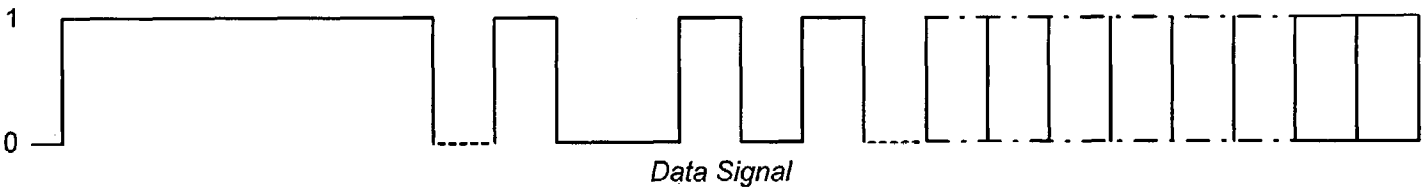
FIG. 16B is a drawing of the data stream showing the relationship of the pulses, when sampled by the "Sampled Data Strobe," shown in FIG. 16C, to the picket fence shown in FIG. 16A.
Figure 16C:
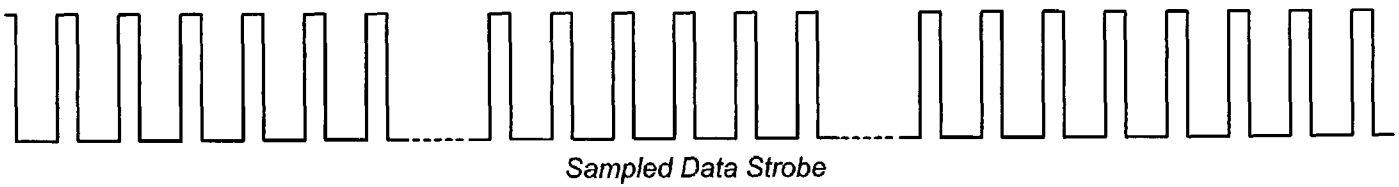
FIG. 16C is a drawing of the "Sampled Data Strobe," needed to sample the data stream of FIG. 16B.
Figure 17A:
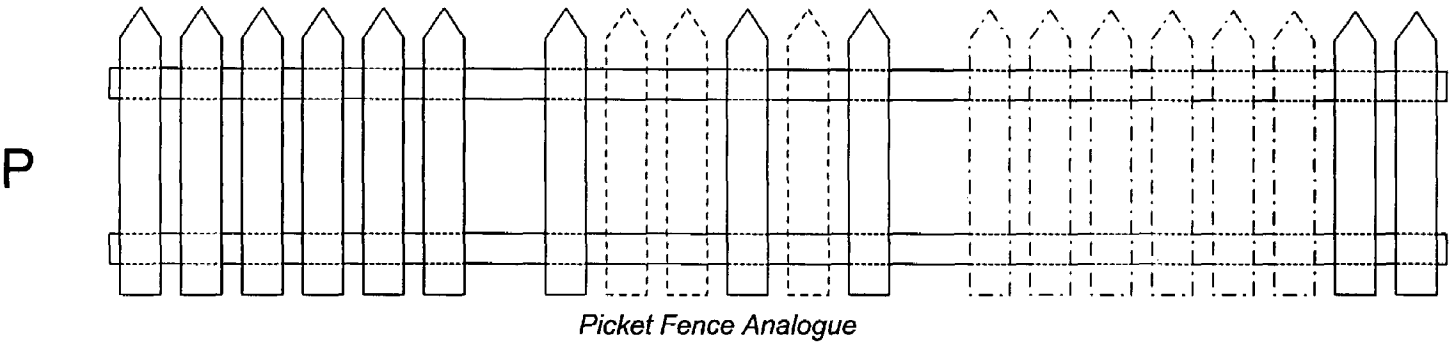
FIG. 17A is a drawing showing a typical 6-bit data cell picket fence "P", which is identical to the picket fence shown in FIG. 16A.
Figure 17B:
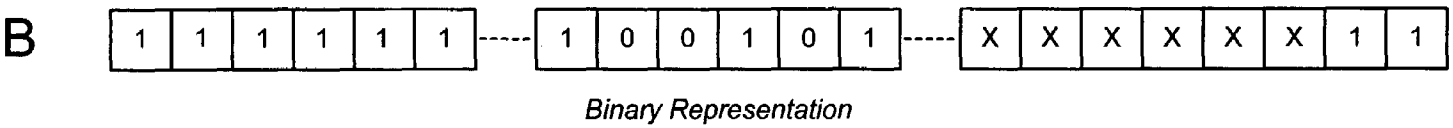
FIG. 17B is a drawing showing the binary bit representation of the typical 6-bit data cell bit pattern "B."
Figure 17C:
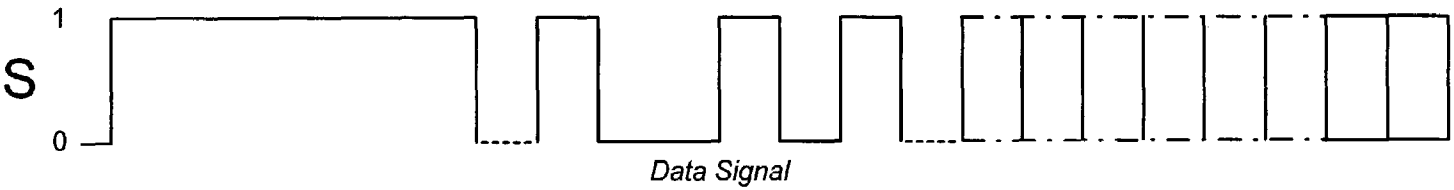
FIG. 17C is a drawing of the datastream "S," which is identical to the data stream shown in FIG. 16B.

FIG. 17A shows the picket fence analogue, which the same as that shown in FIG. 16A, where each picket of the fence is analogous to Weighted Binary Representation, shown in FIG. 17B, where the "1" level represents the presence of a picket on the fence and the "0" level represents the absence of a picket on the fence. FIG. 17C, the Data Signal "S" is identical to the Data Signal shown in FIG. 16B.

Figure 18:
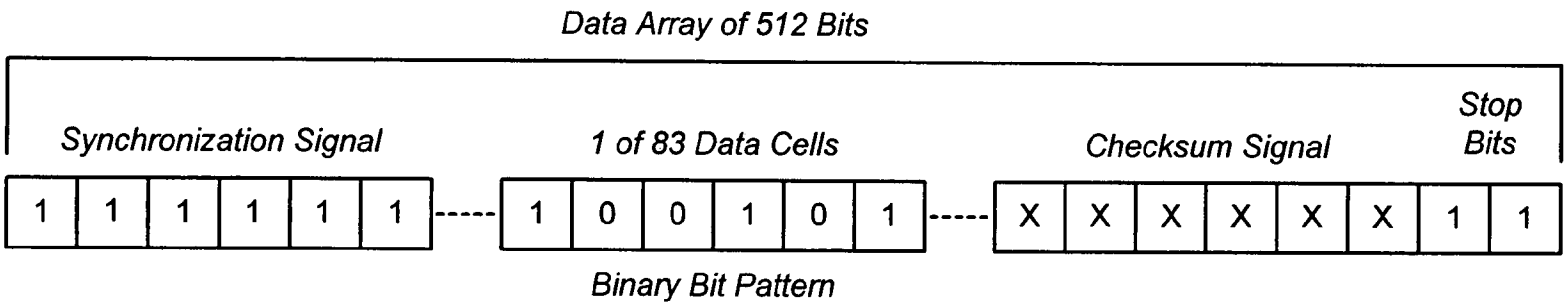
FIG. 18 is a drawing showing a typical 6-bit data array "A," comprising a data array of 512 bits: (1) the first cell being a 6-bit synchronizing signal, (2) one of 83 Data Cells and (3) a checksum signal followed by 2-stop bits.

Turning now to FIG. 18, there is shown a typical Data Array of 512 bits, comprised of Data Cells that are typically 6-bits in length. This is by example only, because while the Data Array may be 512 bits or more, the Data Cells may be 6-bits or greater in length. The sequence of the first 6-bits constitute a Synchronization Signal, giving a special meaning of "Data Follows." Next in the sequence are the plurality of 6-bit Data Cells containing the stored data, which may be normal data, compressed data, or encrypted data, as determined by the stored values in the header portion, followed by two-stop bits, an end-of-file mark.

It should be understood that there may be numerous modifications, advances or changes that can be made to the present invention, but in doing so, it is intended that they should not detract from the true spirit of the present invention.

We claim:

1. A system for imparting digital data in a workpiece, comprising:

a means for embedding an invisible magnetic imprint in the workpiece, wherein said imprint contains digital data that is stored and retrieved as a packed, high density, digital packet, located in predetermined locations on the workpiece;

the digital packet comprising a basic data file used for storing or retrieving the imprint from the workpiece; and a means for error checking in the digital packet.

2. The system as defined in claim 1, wherein a maximum length of the digital packet depends on a bit packing density and upon an available area dedicated to storage of digital data on the workpiece.

3. The system as defined in claim 2, wherein each data packet is divided into a header, a data storage array and a checksum.

4. The system as defined in claim 3, wherein the header contains information needed for storing and retrieving the data.

5. The system as defined in claim 4, wherein the data storage array of the data packet is ultimately retrieved.

6. The system as defined in claim 5, wherein the checksum of the data packet determines an integrity of the retrieved or stored data.

7. The system as defined in claim 6, wherein a signal span of a retrieved digital data packet has a shape analogous to a picket fence.

8. The system as defined in claim 7, wherein each picket of the picket fence contains one bit of stored data.

9. The system as defined in claim 8, wherein each digital data packet has a length ranging from a grouping of 4-bits to as many as 64-bits, dependent upon an application.

10. The system as defined in claim 9, wherein said data storage array in the data packet comprises a workpiece part number, a date of manufacture, a type of material used, a height, a width and other workpiece information.

11. The system as defined in claim 10, wherein the data packet is encrypted for military or other covert applications.

12. A system for imparting digital data in a workpiece, comprising:

a means for locating a desired point on the workpiece;

a means for embedding in the workpiece at the desired point a permanent invisible magnetic tag that provides a retrieved digital signal that has a shape analogous to a picket fence;

wherein each picket of the retrieved digital signal provides a sample pulse with a weighted binary representation that yields a "1" level if a picket is present on the analogous fence and a "0" level indicates an absence of a picket on the fence.

13. The system of claim 12, further comprising a data storage array including 512 or more bits in data cells that are essentially 6-bits or greater in length.

14. The system of claim 13, wherein an initial sequence component of each data storage array includes a first 6-bits that give a synchronization signal with a special meaning of "Data Follows".

15. The system of claim 14, wherein a next component of the sequence of each data storage array includes a plurality of 6-bit data cells containing stored data.

16. The system of claim 15, wherein each data storage array comprises compressed data.

17. The system of claim 15, wherein each data storage array comprises encrypted data, which is determined by stored values in a header portion, followed by two 0-stop bits of an end-of-file mark.

* * * * *